US007394911B2

(12) United States Patent
Joergensen et al.

(10) Patent No.: US 7,394,911 B2
(45) Date of Patent: Jul. 1, 2008

(54) CONTROL PANEL WITH ACTIVATION ZONE

(75) Inventors: Martin Bondo Joergensen, Vaerloese (DK); Joergen Ahm Petersen, Roskilde (DK)

(73) Assignee: Sonian Roskilde A/S, Roskilde (DK)

( * ) Notice: Subject to any disclaimer, the term of this patent is extended or adjusted under 35 U.S.C. 154(b) by 594 days.

(21) Appl. No.: 10/885,073

(22) Filed: Jul. 7, 2004

(65) Prior Publication Data

US 2005/0008178 A1 Jan. 13, 2005

Related U.S. Application Data

(60) Provisional application No. 60/485,110, filed on Jul. 8, 2003.

(51) Int. Cl.
*H04R 25/00* (2006.01)

(52) U.S. Cl. ..... 381/322; 381/324

(58) Field of Classification Search ..... 381/23.1, 381/312, 314, 315, 322, 323, 324; 341/34
See application file for complete search history.

(56) References Cited

U.S. PATENT DOCUMENTS 3,265,819 A * 8/1966 Herrmann ..... 381/323
4,315,111 A 2/1982 Thomas
5,341,433 A * 8/1994 Meyer et al. ..... 381/324
5,353,012 A 10/1994 Barham et al.
5,463,692 A 10/1995 Fackler
5,945,929 A 8/1999 Westra
2004/0013280 A1 * 1/2004 Niederdrank ..... 381/315
2004/0159535 A1 8/2004 Wagner

FOREIGN PATENT DOCUMENTS

EP 1318535 6/2003
WO WO 95/12207 A1 5/1995

* cited by examiner

*Primary Examiner*—Brian Ensey
(74) *Attorney, Agent, or Firm*—Foley & Lardner

(57) ABSTRACT

An interchangeable hearing aid control panel with at least one activation zone arranged in connection with a layered structure. The layered structure has an electrically non-conducting substrate, an electrically conducting path arranged in connection with the substrate, and an electrically conducting member, such as a conducting foil, arranged at a predetermined distance from the activation zone. The activation zone can be either in a deactuated or in an actuated state. In the actuated state the conducting member and the conducting path are electrically connected while disconnected in the deactuated state. Electrical connection to an associated hearing aid is by means of a connector, such as a plug, enabling the control panel to be easily changed. Preferably, the connector is formed by a piece of flexprint. The layered structure may comprise a second conducting path. In preferred embodiments activation zones are indicated by "poppel domes" formed by a surface layer covering the layered structure. The activation zones may form an MTO control or a volume control. To fit BTE hearing aids, the layered structure preferably has an elongated structure with a length of 1-4 cm. Other shapes can be formed to fit ITE, ITC and CIC hearing aids. In preferred embodiments, the control panel comprises one or more Silicon-based microphones protected behind a surface layer of the control panel.

17 Claims, 11 Drawing Sheets

CONTROL PANEL WITH ACTIVATION ZONE

FIELD OF THE INVENTION

The present invention relates to the art of control panels with activation facilities. More particularly the invention relates to interchangeable hearing aid control panels, the control panels featuring activation zones suitable for controlling the function of an associated hearing aid.

BACKGROUND OF THE INVENTION

Modern hearing aids often have a number of operation modes and a number of parameters that can be adjusted by a user. Therefore, such hearing aids should have a control panel with a number of activation facilities such as adjustment means and switches etc. Such a control panel must be easy to operate since often for example a Behind The Ear (BTE) type hearing aid is operated when in position behind the user's ear and consequently it should be operable without visual assistance. In addition, hearing aid users are often elderly people who may be more or less physically disabled. The control panel thus needs a form that enables the user to a have a clear tactile feeling of the control facilities, including a tactile acknowledgement when a control facility has been activated.

Control panels for hearing aids with adjustment facilities for volume control such as rollers or turning knobs are known. Switches are normally implemented as push buttons or they may be implemented with tiltable contact members having two or more positions.

Typically, known hearing aid control panels therefore provides at least two types of activation facilities. This has a number of disadvantages since such control panels will normally require openings in a hearing aid housing so as to allow activation means to have parts protruding from a surface of the hearing aid. However, these openings may allow dirt, moisture and liquids to penetrate through to inner parts of the hearing aid. Especially the presence of rollers or turning knobs, such as used for volume controls, will introduce openings in an outer shield of a hearing aid that can not be sealed. This may disturb its function and even lead to permanent damage of the hearing aid. In addition, a surface not being waterproof makes cleaning more tedious, especially for elderly visually impaired people who might have limited motoric capabilities.

For hearing aid manufacturers control panels for hearing aids normally involve openings in an outer surface of the hearing aid housing so as to allow activation members to protrude from a surface of the hearing aid and be operated by the user. However, this involves a binding with respect to mass production of hearing aids since the control facilities dictate the design of the hearing aid housing, such as with respect to positions and sizes of holes in the outer surface of the hearing aid housing. Therefore, having conventional built-in controls and a dedicated manufacture of the housing such hearing aid is not suited for changes in control facilities. Such control facility changes could be required by the user so as to adapt the hearing aid control to individual needs. It could also be required if new features were added to the hearing aid. With a traditional hearing aid it is not possible to adopt such control facility changes, instead a completely new hearing aid is required. This is a disadvantage with respect to mass production since a number of different hearing aids are necessary in order to provide different control facilities. This makes such changes complicated and expensive.

Consequently, a hearing aid with updated or enhanced control facilities will require design of a new housing and therefore only very few parts of the hearing aid can be reused. This causes such updates or customer specific facilities to be expensive.

SUMMARY OF THE INVENTION

It may be seen as an object of the present invention to provide a control panel that is easily changeable so as to provide different control functions of an associated hearing aid. The control panel must be adapted to provide control of all function parameters of the hearing aid that may be defined by a user. Furthermore, the control panel must be adapted to suit hearing aid types such as Behind The Ear (BTE), In The Ear (ITE), In The Canal (ITC), and Complete In Canal (CIC). Furthermore, the control panel must be suited for low cost mass production. Even further, the control panel should be easy to clean and preferably the control panel should provide a watertight surface of the associated hearing aid. Even further, the control panel must be suited for miniaturisation so as to be suited for hearing aids with very limited space available for control facilities.

The above-mentioned objects are obtained according to a first aspect of the present invention, by providing an interchangeable control panel suitable for use with an associated hearing aid, the control panel comprising:

at least one activation zone capable of being in an actuated and in a deactuated state, a layered structure comprising:

an electrically non-conducting substrate, a first electrically conducting path arranged in connection with the substrate, and an electrically conducting member resiliently arranged at a predetermined distance from the first electrically conducting path, a connector adapted to provide the associated hearing aid with information regarding activation of the at least one activation zone, wherein the first electrically conducting path and the electrically conducting member are electrically connected in the actuated state and disconnected in the deactuated state.

When activated, such as pressed by a user's finger, the at least one activation zone is in its actuated state, and when not pressed, the at least one activation zone is in its deactuated state. It is to be understood that there may be circuitry connected to the control panel so that there exists a certain electrical contact between the conducting path and the conducting member also in the deactuated state. Thus, "disconnected" in the deactuated state is to be construed in an operative way.

Preferably, the at least one activation zone is arranged in connection with the layered structure so that the layered structure is compressed when activated by the user so that the conducting member and the conducting path are brought into contact with each other.

A control panel according to the first aspect provides a control panel requiring only few and simple mechanical parts and it is thus suitable for miniaturisation and low cost mass production.

The connector provides an interchangeable connection to the associated hearing aid. Preferably the connector comprises a plug for providing the associated hearing aid with information via an electrical connection. Preferably, the connector establishes electrical externally accessible contact with at least the first conducting path, in some embodiments the connector additionally established externally accessible contact also with the conducting member. The connector may form an integral part of the electrically non-conducting substrate. The non-conducting substrate may be made of a plastic material: thermo plastics, polyimide, polyethylene, polypropylene, and polycarbonate. Preferably, the non-conducting substrate is made of a flexible plastic material, such as a flexprint.

That the control panel is interchangeable due to the connector, enables the effect that one hearing aid housing can be re-used in connection with different control panels having different activation zone configurations and thus provides different functions. In a manufacturing process this means that one single type hearing aid housing can be used for hearing aids with different features merely by mounting a proper control panel. Thus, the housing can be mass produced and still serve for functionally different hearing aid versions since the difference in functionality can be provided by different control panels having the same outer dimensions so as to be adapted to fit the housing.

The electrically conducting member may comprise an electrically conducting foil.

Preferably, the first electrically conducting path exhibits a specific electrical resistance of more than 1 Ω/m along its major axis of extension, preferably more, such as 10 kΩ/m, 1 MΩ/m, 100 MΩ/m or more. The first electrically conducting path may be made of a carbon-based material. At least one activation zone may be arranged along the first electrically conducting path.

In preferred embodiments the layered structure forms an elongated structure. Preferable, the elongated structure has a length of 1-4 cm so as to fit the size of a hearing aid while still large enough for a user's finger to easily feel the activation zone. The at least one activation zone is preferably arranged along the first electrically conducting path.

The control panel may provide two, three, four or even more activation zones.

An electrical potential difference may be provided between a first and a second end of the first electrically conducting path so as to provide an electrical voltage between the first end of the first electrically conducting path and the electrically conducting member in the actuated state.

In some embodiments it may be preferred that the control panel further comprises a second electrically conducting path arranged in connection with the layered structure so as to be in electrically connected to the electrically conducting member in the actuated state. The second electrically conducting path may be based on: Ag, Au, Cu, and Pb. The first and second electrically conducting paths may be arranged substantially parallel to each other.

The control panel may be adapted to provide an operator with a tactile feedback upon activation of the at least one activation zone. The layered structure may further comprise a surface layer. The surface layer may be an electrically non-conducting foil based on: thermo plastics, polyimide, polyethylene, polypropylene, and polycarbonate. The tactile feedback upon activation may be provided by a resilient dome formed by the surface layer.

The connector may further comprise a communication unit with an electronic circuit electrically connected to at least the first conducting path for receiving and processing a first activation signal upon activation of the at least one activation zone. The communication unit may provide a second activation signal according to the first activation signal. The second activation signal may be a digital electrical signal. The communication unit may further be adapted to provide wireless communication with the associated hearing aid. If preferred, the wireless communication may be operated according to Bluetooth communication standards.

The control panel may further comprise one or more integrated miniature microphones, preferably Silicon-based microphones. The layered structure may further comprise a surface layer, and wherein a sound inlet port of the one or more integrated miniature microphones is positioned behind the surface layer so as to protect the one or more integrated miniature microphones.

A first activation zone may serve as a volume control or a switch or a push button. A second and different activation zone may be adapted to be operated as a volume control or a switch or a push button. A third and different activation zone may be adapted to be operated as a volume control or a switch or a push button.

The above-mentioned objects are obtained according to a second aspect of the present invention, by providing a hearing aid comprising a control panel according to the first aspect.

Preferably, the control panel is positioned in a recess on an exterior surface of the hearing aid. The exterior surface of the hearing aid may be a battery door. The hearing aid may be a: BTE (Behind The Ear), ITE (In The Ear), ITC (In The Canal), and CIC (Completely In Canal) type of hearing aid.

With an interchangeable control panel it is possible to re-use a hearing aid housing and electronics even if highly customer specific control facilities are required. Therefore, it is possible to use one single housing for a large number of completely different hearing aid models differing only with respect to the control panel thus enabling mass production of the housing. The housing may even have a simpler shape since special features of the housing facilitating operation of the protrusions need not be integrated in the housing but can rather be integrated into the control panel. In addition, it is easier to make the control section of the hearing aid watertight.

An additional advantage, the hearing aid becomes easy to update. By changing only the control panel a user can adapt the hearing aid according to changes in individual needs, for example caused by changes in hearing loss. Individual needs may also change in case the user's motoric abilities are weakened thus requiring for example a control panel with a larger and more clearly perceptible volume control instead of a control panel with a large number of detailed control parameters.

With an interchangeable control panel having one or more built-in microphones the possibilities of changing the function of a hearing aid dramatically by changing the control panel only. For example it is possible to change a hearing aid from a one-microphone version with spherical sensitivity pattern to a two- or three-microphone version with a directional sensitivity pattern. Provided that the electronics of the hearing aid is prepared to accept inputs of more than one microphone, a change of control panel could be performed by a hearing aid dispenser, by an audiologist, or it could be prepared by a manufacturer so as to adapt the function of the hearing aid to different environments. For example this could be, on one hand, a walk in nature in quiet surroundings, thus demanding maximum sensitivity so as to hear birds singing—a demand best a single microphone with. On the other hand, it may be preferred that the hearing aid is highly directional when being at a party or at meetings so as to facilitate person to person conversation in a noisy environment thus requiring at least two microphones. With microphones positioned in the control panel, the housing of the hearing aid can be re-used by such a conversion.

An additional advantage with an interchangeable control panel with one or more microphones is that changes from a one-microphone function to a multi-microphone module is automatically followed by corresponding changes in control facilities. Normally, multi-microphone hearing aids require extra control features relating to control of a directional characteristics made available by more than one microphone.

Having microphones and control panel integrated such extra control facilities will automatically follow by conversion of a hearing aid from one-microphone to multi-microphone function thus avoiding additional modifications of the hearing aid.

By integrating the control panel with the battery door of the hearing aid it is possible to save space and at the same time minimise the number of openings in the housing that need to be sealed so as to provide a watertight surface of the hearing aid.

BRIEF DESCRIPTION OF DRAWINGS

In the following the invention is described in more details with reference to the accompanying drawings of which

Figure 1:
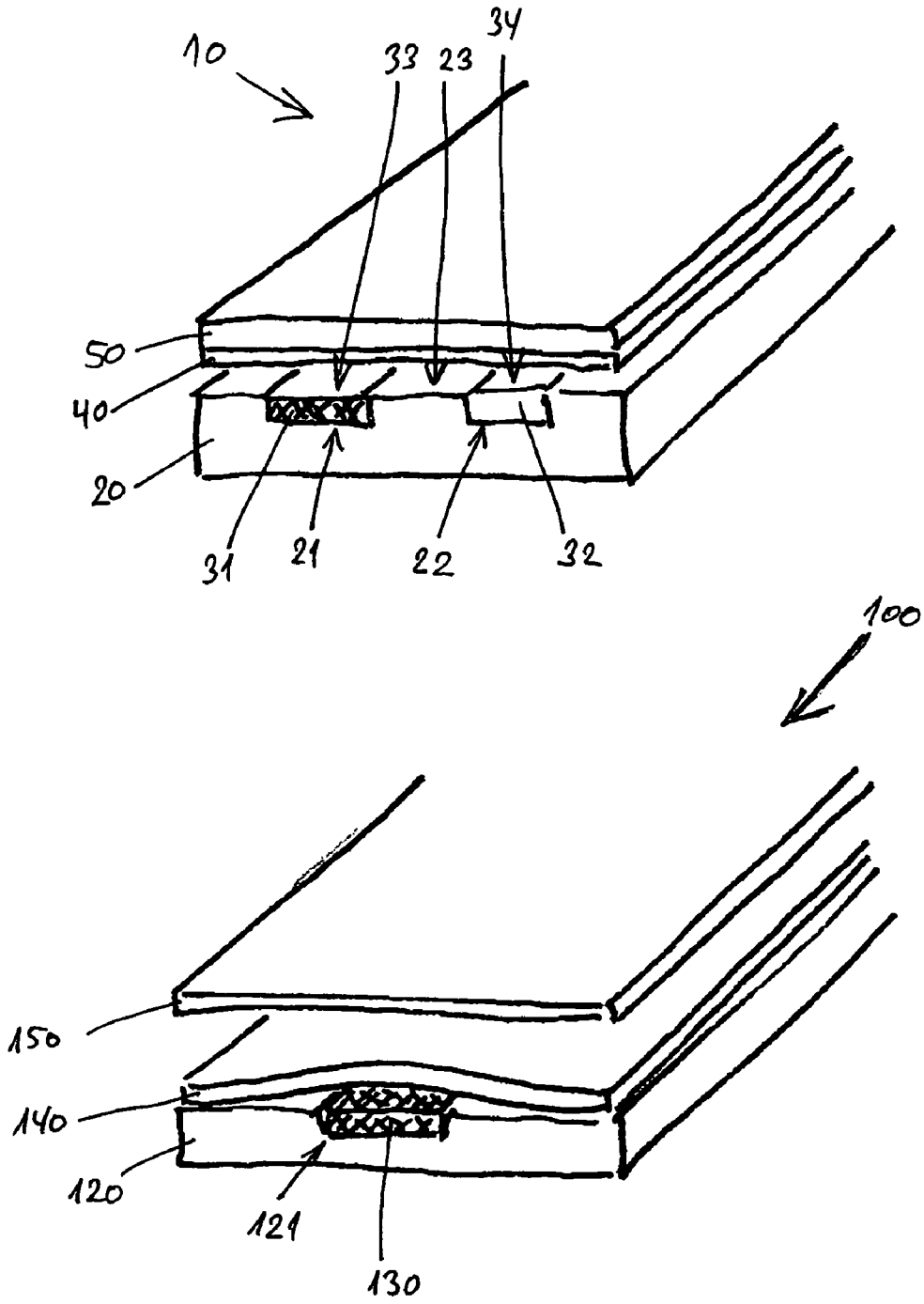
FIG. 1 shows partly exploded views of cross sections of two different designs.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE INVENTION

FIG. 1 shows cross sections of two ways of providing an activation zone of a control panel according to the present invention.

Upper part of FIG. 1 shows a first control panel 10 comprising an electrically non-conducting substrate 20 with a first recess 21 and a second recess 22. The substrate 20 is substantially flat. A first electrical conducting path 31 is positioned in the first recess 21 and a second electrical conducting path 32 is positioned in the second recess 22. The conducting paths 31,32 are positioned so that they are not in electrical connection. An upper surface 33 of the first conducting path 31 is substantially in plane with an upper surface 23 of the substrate 20. It may be preferred that the upper surfaces 33,34 of the two conducting paths 31,32 are positioned slightly above the surface 23 of the substrate 20. An electrically conducting member 40 formed as a foil of an electrically conducting material is positioned a certain distance above the upper surfaces 33,34 of the two conducting paths 31,32. The distance must be so large that the foil 40 is not in contact with both conducting paths in a deactuated state of the activation zone. The foil 40 is attached to a surface layer 50 of a non-conducting material. The foil 40 may be attached to the surface layer 50 by means of adhesives. A flexible printed circuit board, a flexprint, may be used to implement such a structure of a surface layer 50 and a conducting foil 40.

The principle according to the upper part of FIG. 1 may be used to form an activation zone as a push button. If a zone of the surface layer 50 is activated, i.e. pressed towards the substrate 20 to a degree so that the conductive foil 40 will touch at least one of the surfaces 33,34 of the conducting paths 31,32 and thus establish an electrical connection between at least the foil 40 and one of the conducting paths 31,32. This electrical connection may be sensed by electronic means connected, via a connector of the control panel, to the foil 40 and the conducting paths 31,32 so as to detect if the activation zone is in an actuated state. The simple push button function may be implemented with one of the two conducting paths 31,32 only. In this situation an activation can be detected by sensing electrical connection between the foil 40 and one of the conducting paths 31,32. If both conducting paths 31,32 are present an activation may be detected by sensing electrical connection between the two conducting paths 31,32.

The surface layer 50 may be used to form a resilient dome, i.e. a three-dimensional shape often referred to as a "poppel dome", thus providing a mechanical indication of the activation zone. When activating the "poppel dome" by pressing it with a finger a user will be provided with a tactile acknowledgement upon activation since the "poppel dome" will indicate a change in state from deactuated to actuated by a "click". Thus, a user is informed that his activation has caused the activation zone to switch to its actuated state.

In addition, a change in state from actuated to deactuated can be acknowledged likewise. The "click" can be tactically perceived by the user and it may in addition generate an audible "click".

Instead of a "poppel dome" the surface layer 50 may form a long dome shape thus defining an activation zone that allows a user to press the activation zone in different positions along the conducting paths 31,32. It may be interesting to be able to detect which position of the activation zone is being activated. This may be used to generate a potentiometer function for example to be used as a volume control or other parameters that preferably is adjusted by the user by sliding his/her finger. The detected position of the long dome activation zone of the control panel 10 may be implemented by one of the conducting paths 31,32 being a conductor with a material having a substantial specific electrical resistance, such as a minimum of 1 Ω/m, preferably more, such as 1-100 MΩ/m.

For example the first conducting path 31 may comprise carbon, such as a carbon track with silver and a lacquer of phenol. The second conducting path 32 may be a conductor of a material with a low relative electrical resistance such as copper, aluminium, silver, gold etc. If in addition, the conducting foil 40 is of a material with a low relative electrical resistance, such as a metal, an activated position along the conducting paths 31,32 may be detected by using the first conducting path 31 to establish a potentiometer which may be operated according to the well known voltage divider principle. A voltage may be applied between the two ends of the first conducting path 31. The activated position can then be determined by sensing which portion of the voltage is present between one end of the first conducting path 31 and the second conducting path 32. A long dome may be formed with a surface layer 50 providing a user with a tactile acknowledgement upon activation of the activation zone.

A control panel 100 according to the lower part of FIG. 1 has a non-conducting substrate 120 with a recess 121 in which an electrical conducting path 130 is positioned. An electrically conducting member 140, such as a metal foil, is positioned a certain distance above the substrate 120 so as not to touch the conducting path 130 in a deactuated state. A surface layer 150 is positioned above the conducting member 140 so as to protect the conducting member 140.

A "poppel dome" activation zone that may be used as a push button may be formed by the surface layer 150 of the control panel 100. If the activation zone is pressed the conducting member 140 is pressed towards the substrate 120 and it may establish an electrical connection to the conducting path 130. Activation of the activation zone may therefore be sensed by detecting an electrical connection between the conducting member 140 and the conducting path 130.

Figure 2:
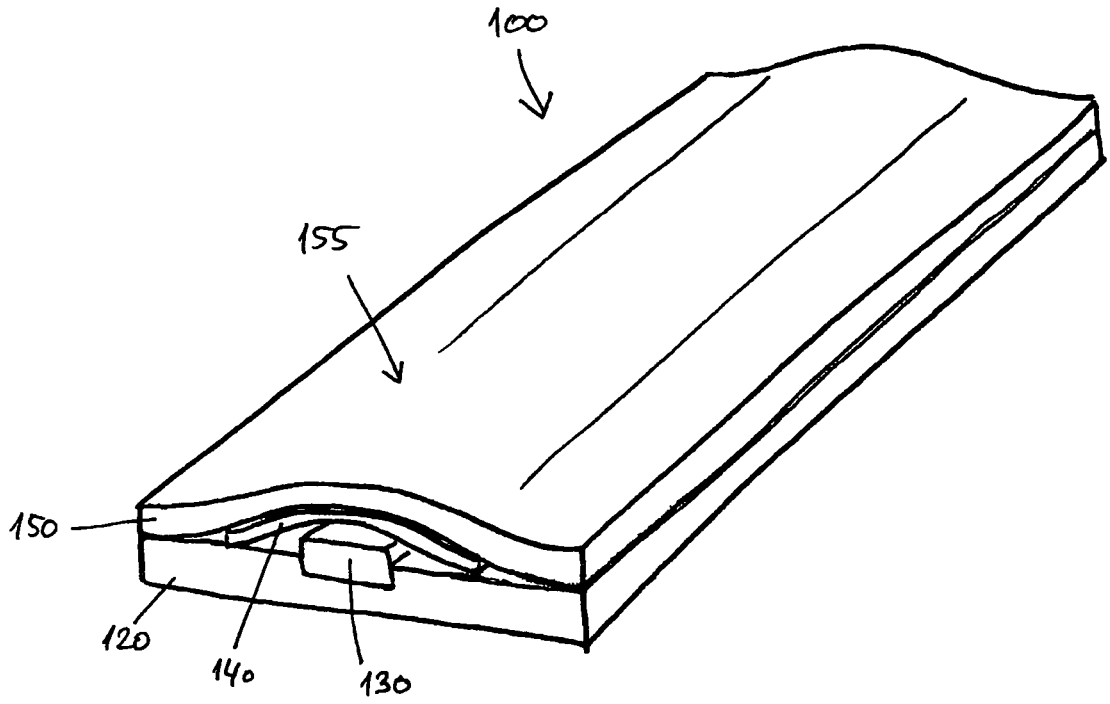
FIG. 2 shows an assembled long dome embodiment.

FIG. 2 shows a long dome activation zone formed according to the principle sketched for the control panel 100 shown in lower part of FIG. 1. In FIG. 2 the conducting member 140 may be attached to the substrate 120 on both sides of the conducting path 130 thus allowing the conducting member 140 to have a curved shape thus providing a distance between the conducting path 130 and the conducting member 140 in a deactuated state. The conducting member 140 may be attached to the substrate by means of adhesives. The curved shape of the conducting member 140 provides a spring effect thus causing the conducting member 140 to return to its initial position, i.e. its deactuated state, after activation. If the conducting member 140 is a metal sheet with appropriate elastic properties the conducting member 140 may not need to be attached to the substrate 120 in order to return to its initial deactuated state after being activated. Instead it may be fixed into position merely by the surface layer 150 which may be attached to the substrate 120 by means of adhesives on both sides of the conducting path 130, allowing the necessary space for the conducting member 140.

An activation position on the surface 155 of the surface layer 150 may be sensed if the conducting path 130 is formed by a material having a substantial specific electrical resistance, for example 1-100 MΩ/m or more, measured in the direction of a longitudinal extension of the conducting path 130. A voltage is applied between both ends of the conducting path 130. The activated position can then be detected by sensing which portion of the voltage is present between one end of the conducting path 130 and the conducting member 140. A long dome may be formed with a surface material 150 providing a user with a tactile acknowledgement upon activation of the activation zone such as a "click" so as to indicated an acutated state.

Activation parameters for the embodiments shown in FIGS. 1 and 2, such as a force and a travel necessary for entering the acuated state, can be determined by means of material parameters for the surface layer 50,150 and a physical shape of the surface layer 50,150. The distance between the two layers 40,50 or 140,150 determines the travel necessary for activation. The two layers 40,50 or 140,150 may be attached to the substrate 20,120 forming a velvet shape in the area occupied by the conducting path(s) 31,32,130. Hereby, the elastic material of the layers 40,50 or 140,150 will be one factor determining a force necessary to enter the actuated state.

Figure 3:
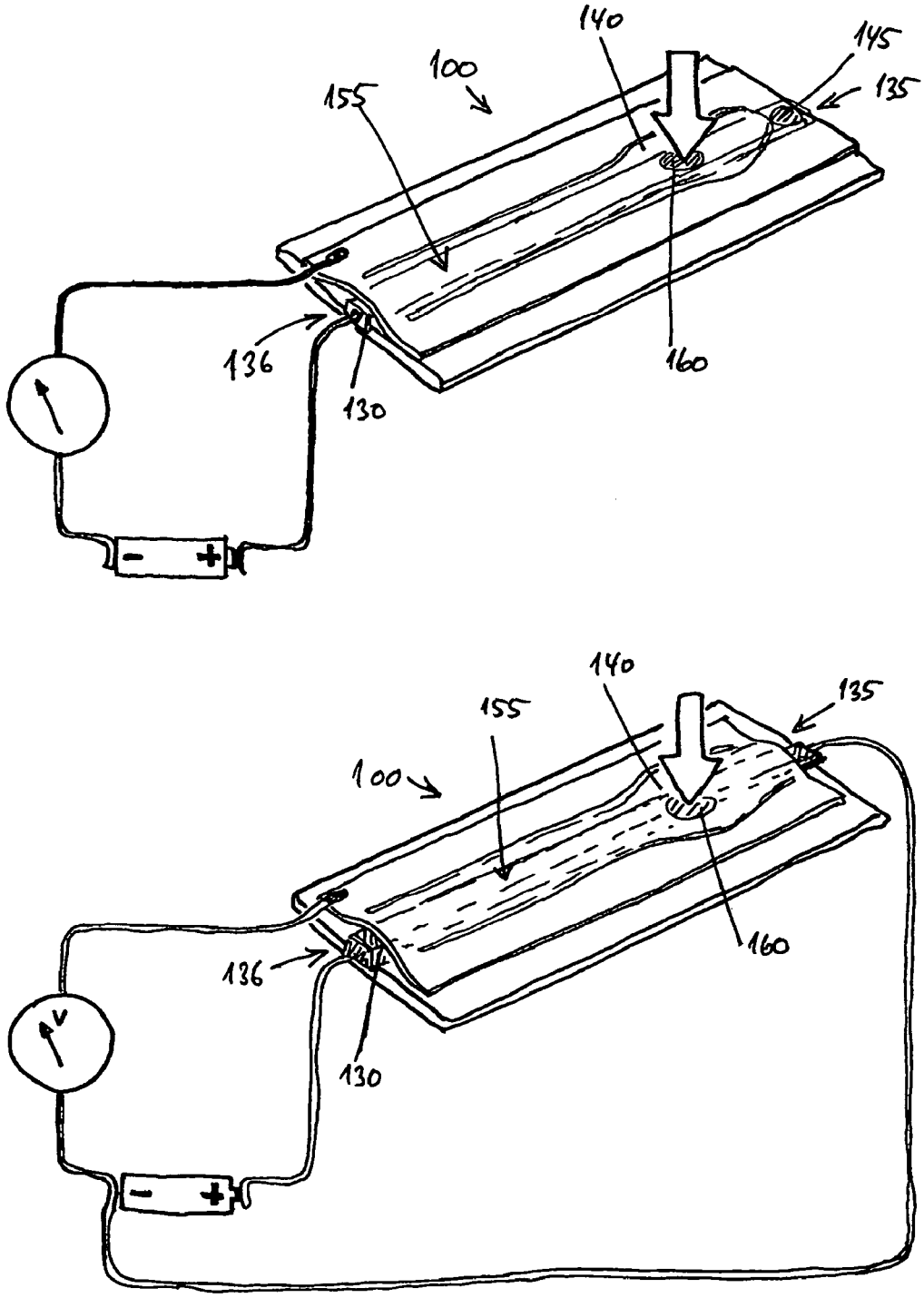
FIG. 3 shows principles of measurement of resistance and leak voltage in a compressed state.

FIG. 3 illustrates two possible ways of electrically terminating a control panel 100 similar to the one shown in FIG. 2. The control panel 100 is shown with a part of the activation zone in an actuated state. The activation position 160 is indicated by a white arrow in both upper and lower part of FIG. 3. The white arrow indicates a pressure applied to the upper surface 155 of the surface layer 150 thus causing the conducting member 140 to establish electrical contact with the conducting path 130.

Upper part of FIG. 3 shows an electrical coupling in which one spot 145 of the conducting member 140 is electrically connected to the conducting path 130 at a position towards a first end 135 of the conducting path 130. An electrical resistance that can be observed between a second end 136 of the conducting path 130 and the conducting member 140 will depend on the activation position 160 along the conducting path 130 where the activation zone is depressed so as to provide electrical contact between the conducting path 130 and the conducting member 140. If the activation position is close to the first end 135 of the conducting path 130, i.e. close to the connection spot 145, a small electrical resistance can be observed. A maximum resistance can be observed if the activation position is close to the second end 136 of the conducting path 130.

Lower part of figure 3 shows an alternative electrical connection of the control panel 100 using a voltage divider principle. A voltage is applied between the first end 135 and the second end 136 of the conducting path 130. When electrical contact is provided between the conducting path 130 and the conducting member 140 at the activation position 160 a voltage can be observed between the first end 135 of the conducting path 130 and the conducting member 140.

The conducting path 130 may be formed so as to provide an electrical resistance which is a linear function of the position along the conducting path 130. It may also be preferred to have a conducting path 130 in which the electrical resistance is a logarithmic function of the position along the conducting path 130.

Figure 4:
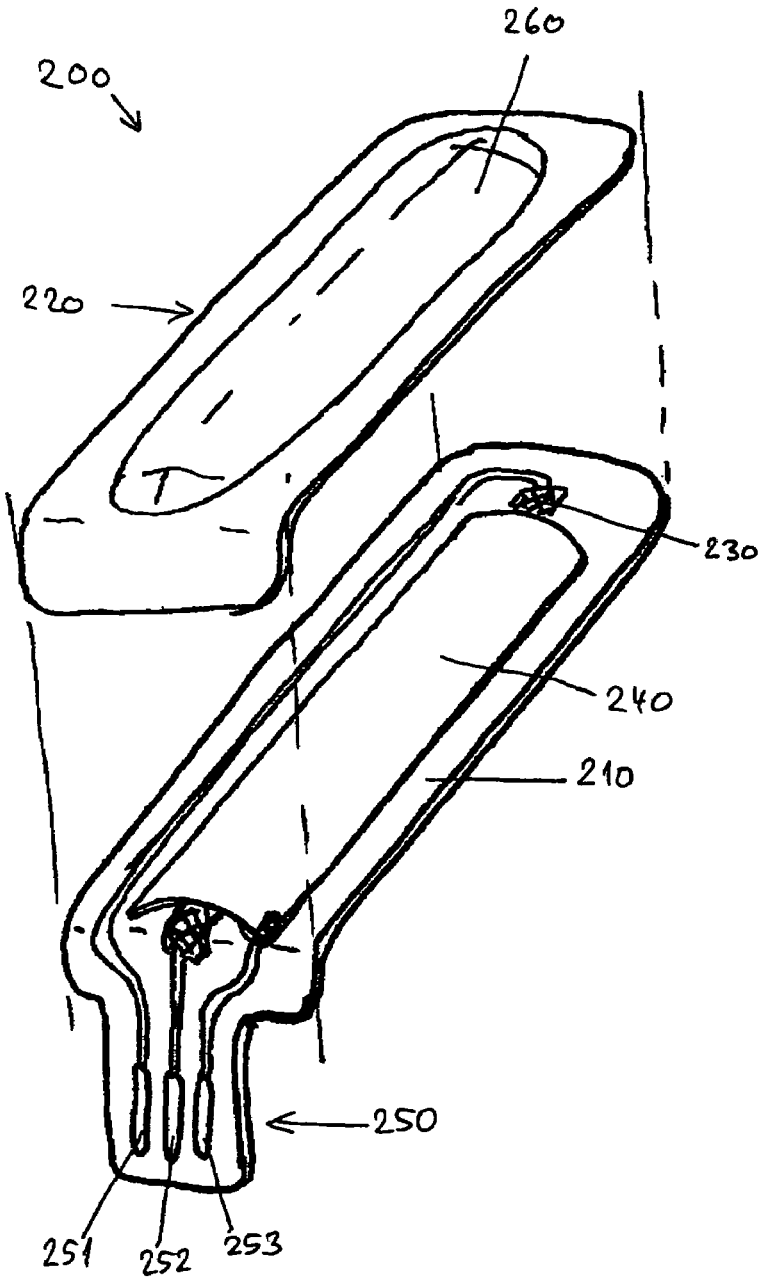
FIG. 4 shows a partly exploded view of a long dome embodiment comprising electrical terminals for external connections.

FIG. 4 shows an exploded view of a full embodiment 200 of a long dome comprising also a communication unit 250 in a simple form. The embodiment 200 of FIG. 4 is adapted to provide information to an associated hearing aid about an actuated state of an activation zone according to either upper part or lower part of FIG. 3. A substrate 210 may be formed by a flexible sheet such as a flexible Printed Circuit Board (PCB), i.e. a flexprint. The substrate 210 carries a conducting path 230, such as a carbon-based conductor. In addition, the substrate 210 carries conductors serving for connecting both ends of the conducting path 230 with the communication unit 250. A conducting member 240 is formed by a metal foil or a metal sheet and it is arranged along the conducting path 230 in a velvet form so as to provide a certain distance between the conducting member 240 and the conducting path 230 so as to ensure that a certain pressure is required in order to provide a contact between the conducting path 230 and the conducting member 240. The conducting member 240 is also connected to the communication unit 250 via a conductor positioned on the substrate 210. As mentioned with regard to FIG. 1, activation of the activation zone may be sensed by detecting an electrical connection between the conducting member 240 and the conducting path 230.

An surface layer 220 is formed by a non-conducting foil or sheet of a material and a thickness adapted to provide a long dome shape 260 that allows a depression by a touch of a finger and still return to its original shape when the pressure is released. The material for the surface layer 220 may be a plastic type. Preferably, the long dome shape 260 provides a tactile "click" indicating to a user that a sufficient pressure has been applied in order to provide contact between the conducting path 230 and the conducting member 240. The surface layer 220 may be glued to the substrate 210 50 as to provide a watertight encapsulation of the conducting path 230 and the conducting member 240.

The communication unit 250 is formed as an integral part of the substrate 210. The communication unit 250 provides a termination of the conductive elements 230,240. Altogether a termination part of the communication unit 250 comprises three terminals 251,252,253. The communication unit 250 is shaped as a plug adapted to fit a socket in an associated hearing aid. A flexible substrate 210 facilitates mounting of the control panel 200 to a housing of the associated hearing aid.

The long dome embodiments described above may serve as adjustment means such as volume controls or adjustment of other parameters. The activation zone of such embodiments forms a physical mapping of a one-dimensional scale where a position on the activation zone corresponds to a value of the adjustment parameter. The operation of such a control may be performed by sliding a finger along the activation zone, on the surface 50,150 layer, while applying a pressure. Sliding in one direction will provide the adjustment parameter to be adjusted in one direction while sliding in the opposite direction will provide the adjustment parameter to be adjusted in the opposite direction. This allows a user to adjust a parameter successively to a proper, such as adjusting volume to a pleasant level according to a surround sound level similar to operating a turning knob or a roller.

An alternative mode of operation for a long dome embodiment is to indicate a desired adjustment by pressing the activation zone at a position corresponding to the desired level of the adjustment parameter. This way of operation can be used to abruptly alter the setting of the adjustment parameter, such as turning down volume if unpleasant loud sounds are heard.

In order to guide the hearing aid user for operation of an adjustment control, such as a long dome, without orientation on the adjustment scale by sight a small protrusion may be positioned on the surface layer 50,150 in order to indicate a centre of the adjustment scale so as to help the user to activate the activation zone at a proper position. This will help prevent accidental high volume settings that may lead to unpleasant loud sounds.

Figure 5:
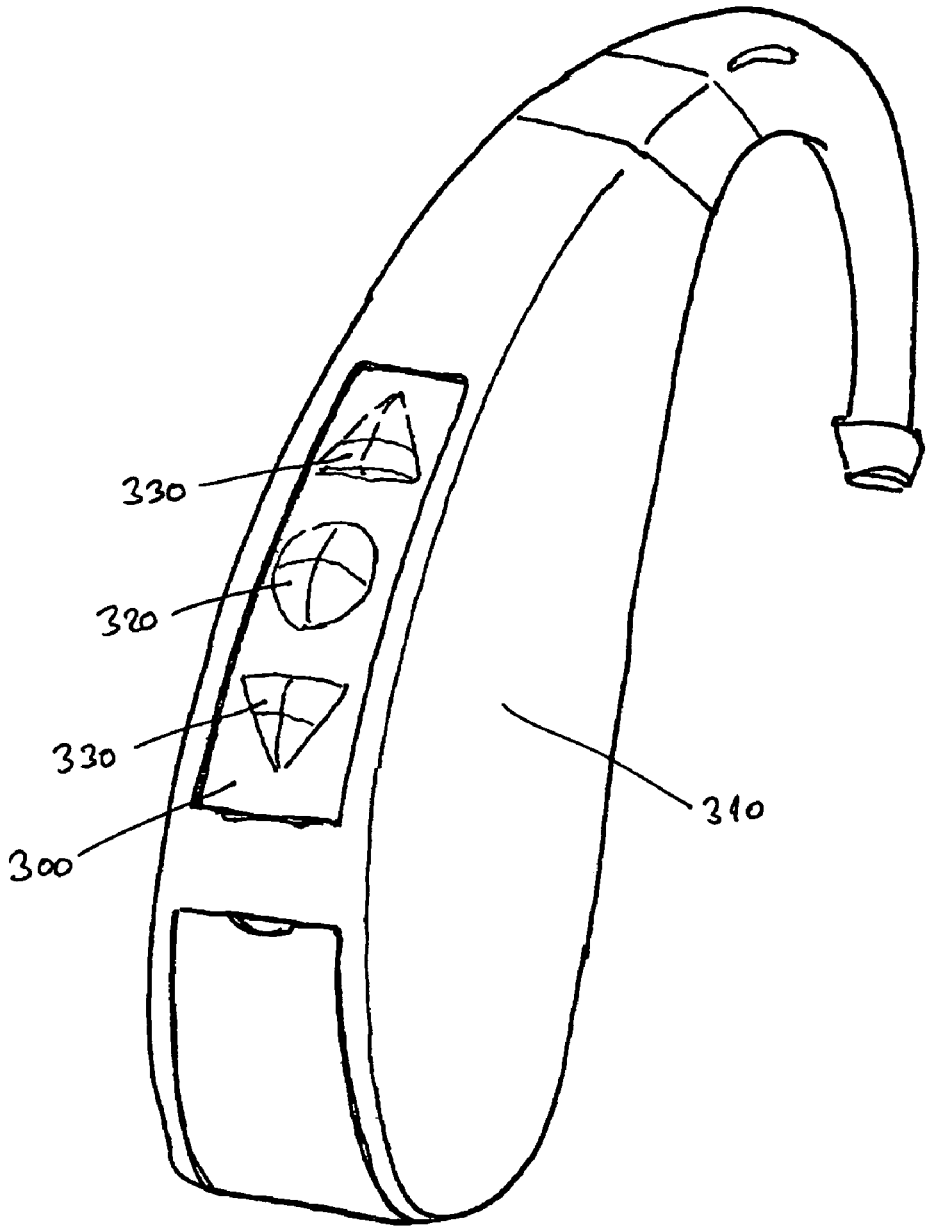
FIG. 5 shows a BTE hearing aid with a control panel comprising three push knobs.

FIG. 5 shows a control panel 300 positioned BTE type hearing aid 310. The control panel has three activation zones 320,330 being—one round zone 320 and two arrow shaped zones 330. The three activation zones 320,330 are shaped by an upper layer of the control panel. The two arrow shaped activation zones 330 may serve as volume control of the hearing aid, one activation zone serves for upward adjustment and one serves for downwards adjustment. The round zone 320 may be used to toggle between Microphone, Telephone and Off (MTO). The three-dimensional shape of the domes forming each of the activation zones 320,330 serves as a tactile guide to a user enabling the user to select a desired activation zone 320,330 without visual assistance. The shape of the activation zones 320,330 can be formed with smooth curves so as to leave the surface of the control panel 300 easy to clean.

In the embodiment of FIG. 5 the control panel 300 is positioned in a recess on an exterior surface of the BTE, more specifically it is positioned on a backside of the BTE housing 310. Hereby an easy access to the activation zones 320,330 is provided when the BTE is positioned on the user's ear. Preferably, the control panel 300 is mounted with a watertight sealing to the BTE housing 310. The control panel 300 may be fastened to the BTE by various fastening methods that allow the control panel 300 to be dismantled so as to be changed to another panel with a different set of activation zones. The control panel 300 may for example be kept in place by a small protrusion fitting in a corresponding recess in the BTE housing 310. Due to its flexible substrate the control panel 310 can be bent in order to release the protrusion from the recess in the recess in the BTE housing 310. Various other attachment methods may be used such as known to the skilled person.

Figure 6:
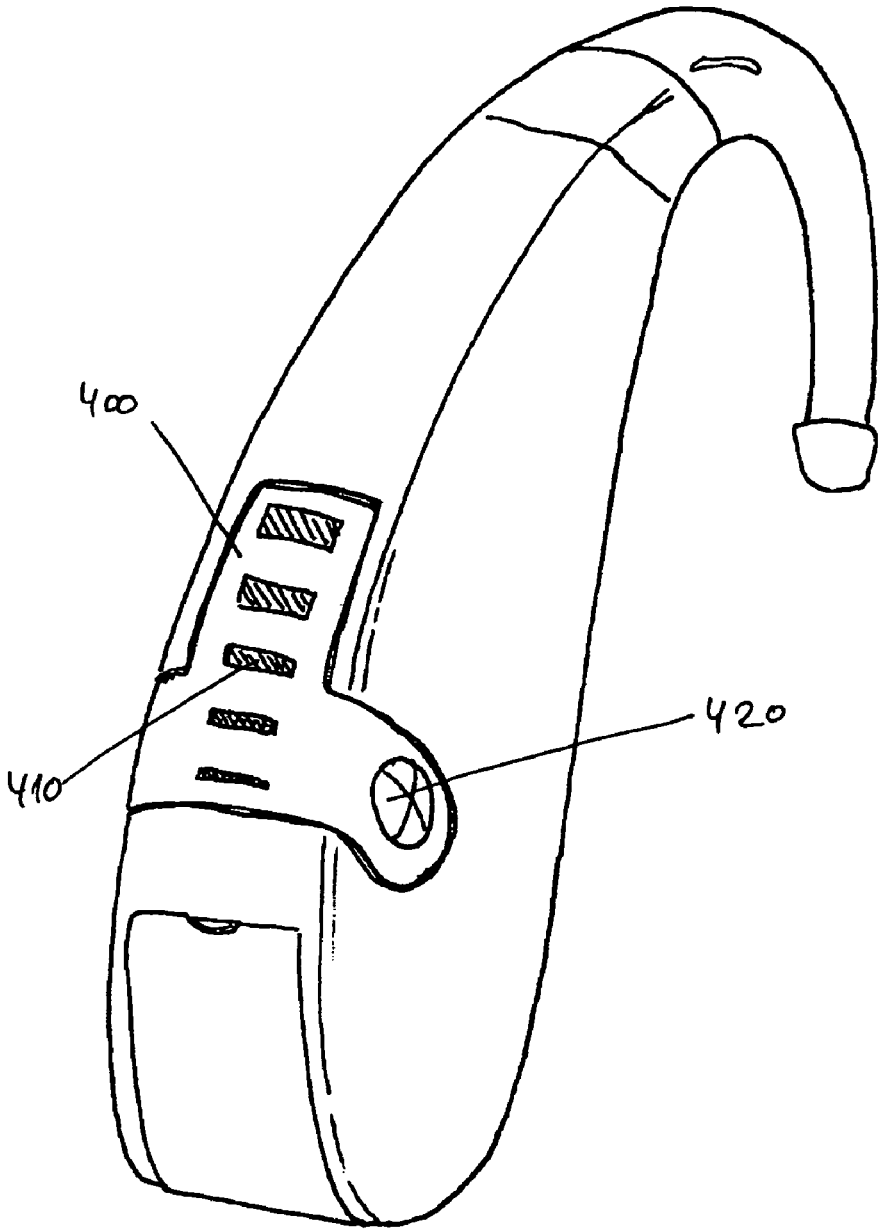
FIG. 6 shows a BTE hearing aid with a control panel comprising a long dome volume control and two push knob domes positioned on two sides of the hearing aid.

FIG. 6 shows a control panel 400 mounted on a BTE. As in FIG. 5 this embodiment of the control panel is positioned in a recess on an exterior surface of the housing of the BTE. However, in FIG. 6 the control panel extends from one side, via a backside and to another side of the BTE housing. A backside part of the control panel 400 has five activation zones 410 with different sizes thus indicating to a user five different preset volume settings. A side part of the control panel 400 has a round activation zone 420 that may be used as input selector. A second side part of the control panel 400 (not visible) may have one or more additional activation zones serving, for example, for control of compression level or other function relevant parameter.

Figure 7:
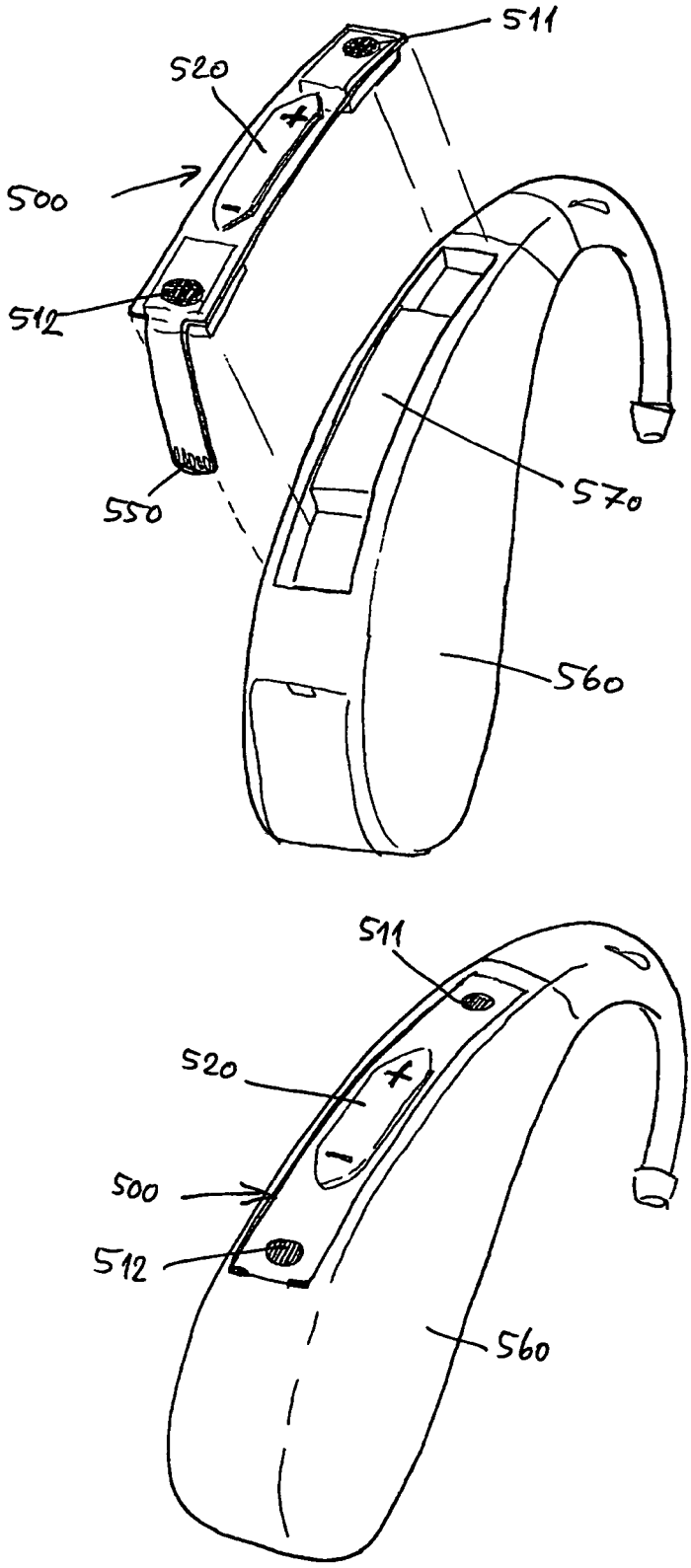
FIG. 7 shows a BTE hearing aid with a control panel comprising a long dome switch and two microphones, the hearing aid being shown in situations with the control panel removed and the control panel mounted.

FIG. 7 shows an embodiment with a control panel 500 for a BTE hearing aid with integrated microphones 511,512. Upper part of FIG. 7 shows the control panel 500 dismantled from the housing 560 of the hearing aid thus enabling a view of recesses 570 in the housing 560 in which the control panel 500 fits. Lower part of FIG. 7 shows the control panel 500 mounted on the hearing aid.

An activation zone 520 is formed as a long dome and serves as volume control in which a pressure applied to one end indicated with "+" will increase volume, whereas a pressure applied to the other end indicated with "–" will decrease volume. Additional activation zones could be applied if preferred, for example for control of a directivity that may be available due to the two-microphone design. The microphones 511,512 are integrated with the control panel 500. Electrical connection of the microphones 511,512 is established via conductors on a substrate part of the control panel 500 that connects the microphones 511,512 to the communication unit 550. The communication unit 550 is an integral part of the substrate and has at its end a set of contacts adapted to fit a corresponding socket (not shown) within the hearing aid. The communication unit establishes contact to the hearing aid from microphones 511,512 as well as activation zone 510.

An upper layer of the control panel in the area in front of the microphones is preferably formed thin so as to be substantially acoustically transparent. Hereby, the upper layer can be formed in one piece also covering the microphones 511,512 and it thus serves to protect the microphones 511,512 against dirt and humidity without considerable attenuation of sound waves reaching the inlet port of the microphones 511,512. The microphones 511,512 may be silicon-based microphones since these microphones can be formed very slim and thus are suited for integration into the control panel. Having slim microphones 511,512 the control panel can be fitted onto an outer surface of an associated hearing aid demanding only a flat recess of very limited deepness.

If a large degree of wear-resistance of the surface layer is required a thicker foil may be used and provided with perforations in the area in front of the microphones 511,512 in order to reduce acoustic transmission loss in the surface layer. The surface layer may also be formed as a thin layer of acoustically transparent foil in the areas in front of the microphones 511,512 and an additional layer of wear-resistant foil in the activation zones of the control panel.

Figure 8:
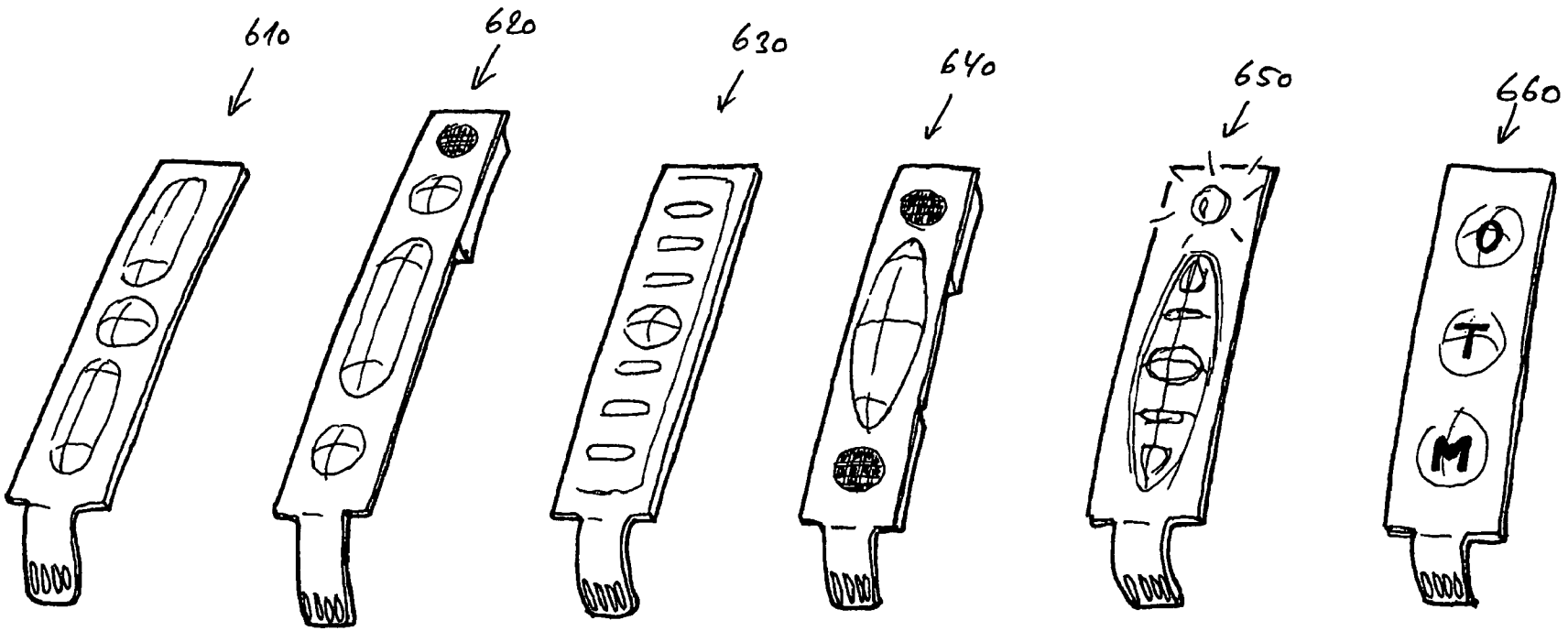
FIG. 8 shows 6 examples of control panels adapted for BTE hearing aids.

FIG. 8 shows six different control panels 610,620,630,640, 650,660 adapted for position on a back part of an associated BTE housing. All six embodiments have a flexible substrate that enables an integrated communication unit providing termination of the features provided on the control panel. The communication unit may establish direct electrical connection between the features and the hearing aid. However, the connector may comprise an electronic circuit so as to provide a coded electrical signal to the hearing aid in accordance with an actuated state of the activation zones on the control panel. The electronic circuit may comprise an analog-to-digital converter so as to provide a digital electrical signal to the hearing aid in accordance with an actuated state of the activation zones. In this way the plug part of the connector can be reduced since a digital electrical signal may require fewer connections than direct analog electrical connections of the activation zones. The analog-to-digtial converter may also be used to convert analog electrical signals from the microphones 511,512 to digital electrical signal. Using a coding technique, for example comprising multiplexing, it may be possible reduce the number of lines to only a power supply line, a ground line, and a digital data line that are needed to provide to the associated hearing aid via the plug part of the communication unit.

The first control panel 610 has three activation zones, one round dome and two long domes. The two long domes may be used to adjust volume and tonal character respectively. The round dome may be used for MTO selector.

The second control panel 620 has two round activation zones and one long dome activation zone. In addition the second control panel 620 has an integrated microphone (round shaded area) positioned with its sound inlet port behind an upper layer of the control panel 620 constituted by a thin foil.

The third control panel 630 has six small domes that may be used for selection among different preset volume settings. A round dome may be used as MTO selector.

The fourth control panel 640 has one large long dome and two microphones (round shaded areas). A centre part of the long dome may be used to control directivity of the two-microphone system whereas the two ends of the long dome may be used to control volume.

The fifth control panel 650 has one long dome with five protrusions indicating different functions of different parts of the long dome. The fifth control panel 650 comprises a light indicator for example implemented with a Light Emitting Diode (LED). The LED may be used to visually indicate a low battery level before the user puts the hearing aid into position.

Figure 9:
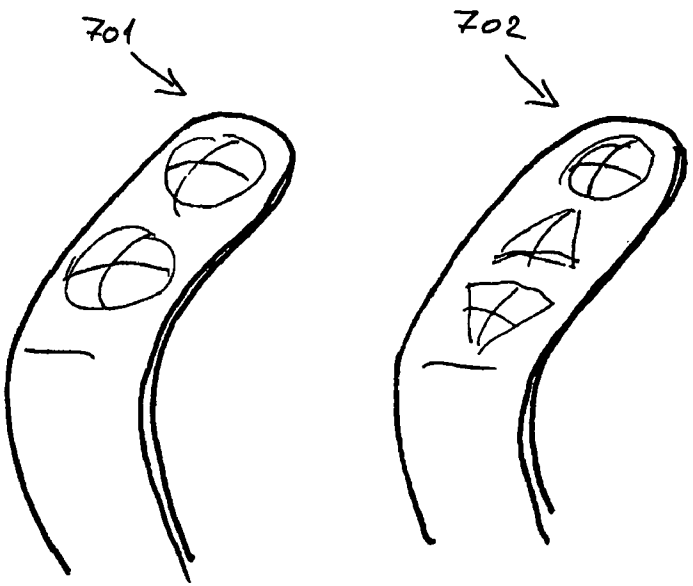
FIG. 9 shows an ITE hearing aid with a control panel mounted, and in addition two control panels adapted for ITE hearing aids.
Figure 9:
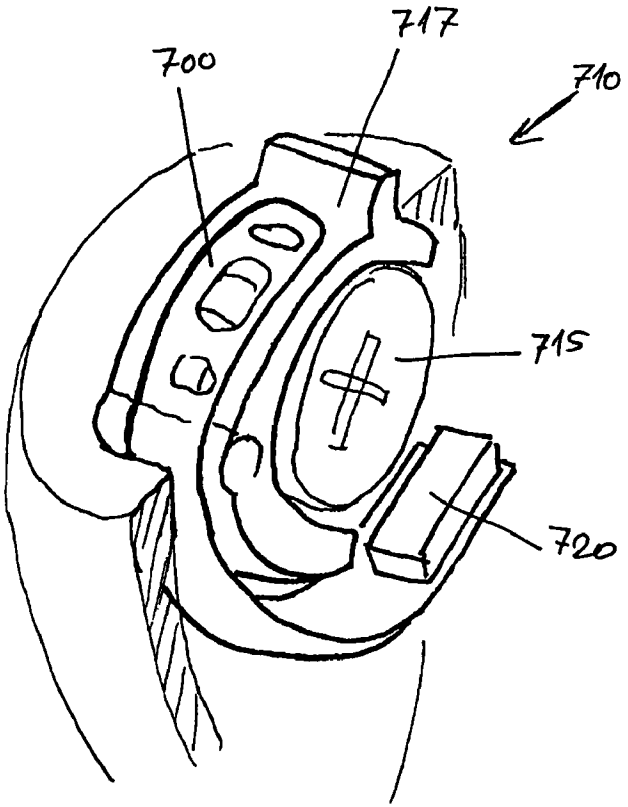

FIG. 9 shows an ITE or ITC type hearing aid 710 with a control panel 700 positioned in a recess in a battery door 717 of the hearing aid 710, the battery door 717 providing access to the battery 715. A plug part of the communication unit 705 of the control panel 700 is connected to a socket 720 of the hearing aid 710. The control panel 710 is able to follow a curvature of the battery door 717 since it has a flexible substrate. The flexible substrate also enables the control panel 700 to bend along with an opening of the battery door 717. To the right of FIG. 9 two embodiments 701,702 of the control panel 700 are shown.

Figure 10:
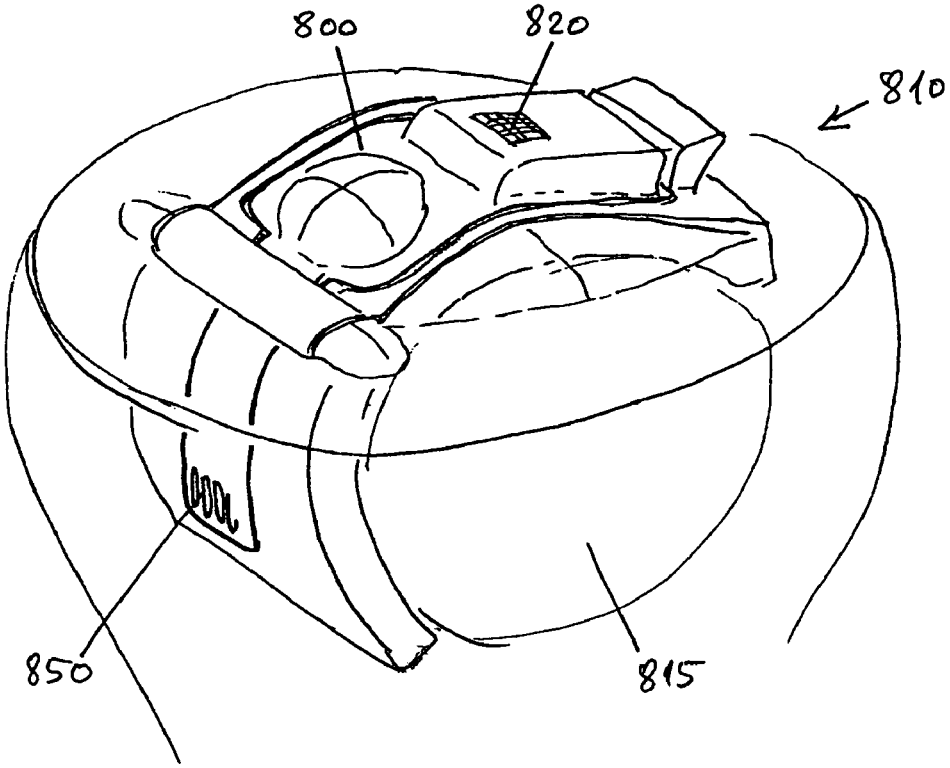
FIG. 10, shows two examples of ITE hearing aids with control panels comprising microphones, the control panels being positioned in battery doors of the hearing aid.
Figure 10:
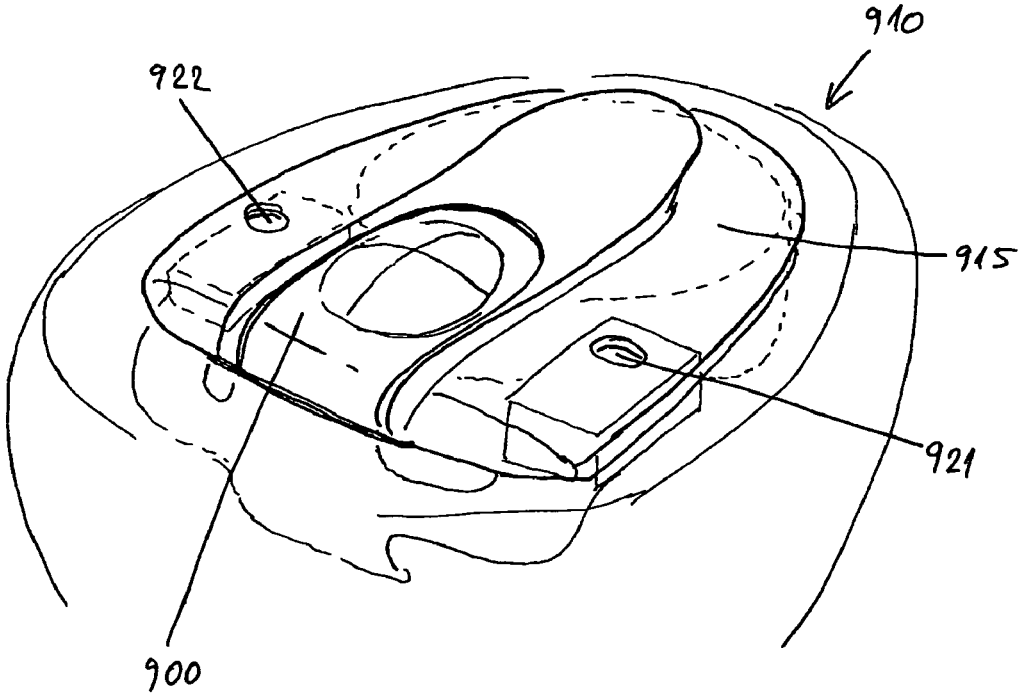

FIG. 10 shows semitransparent views of two examples of ITC type hearing aids 810,910 having control panels 800,900 integrated into their battery doors that provide access to the batteries 815,915. The control panels 800,900 are positioned in and end face of the hearing aids 810,910 facing outwards when mounted in an ear canal of a user. The two hearing aids 810,910 differ with respect to a orientation of the battery 815,915 relative to the hearing aid 810,910.

The control panel 800 in the upper part of FIG. 10 has an integrated microphone 820, such as a silicon-based microphone. The control panel 800 has one activation zone formed as a round dome. This may be used to toggle between different functions, such as MTO. A communication unit part 850 of the control panel 800 is shown in the semitransparent view to be positioned within the hearing aid 710.

The control panel 900 in the lower part of FIG. 10 has two integrated microphones 921,922 and the control panel 900 has an activation zone formed as a round dome. An surface layer of the control panel 900 serves to protect the microphones 921,922 that may be silicon-based microphones.

Figure 11:
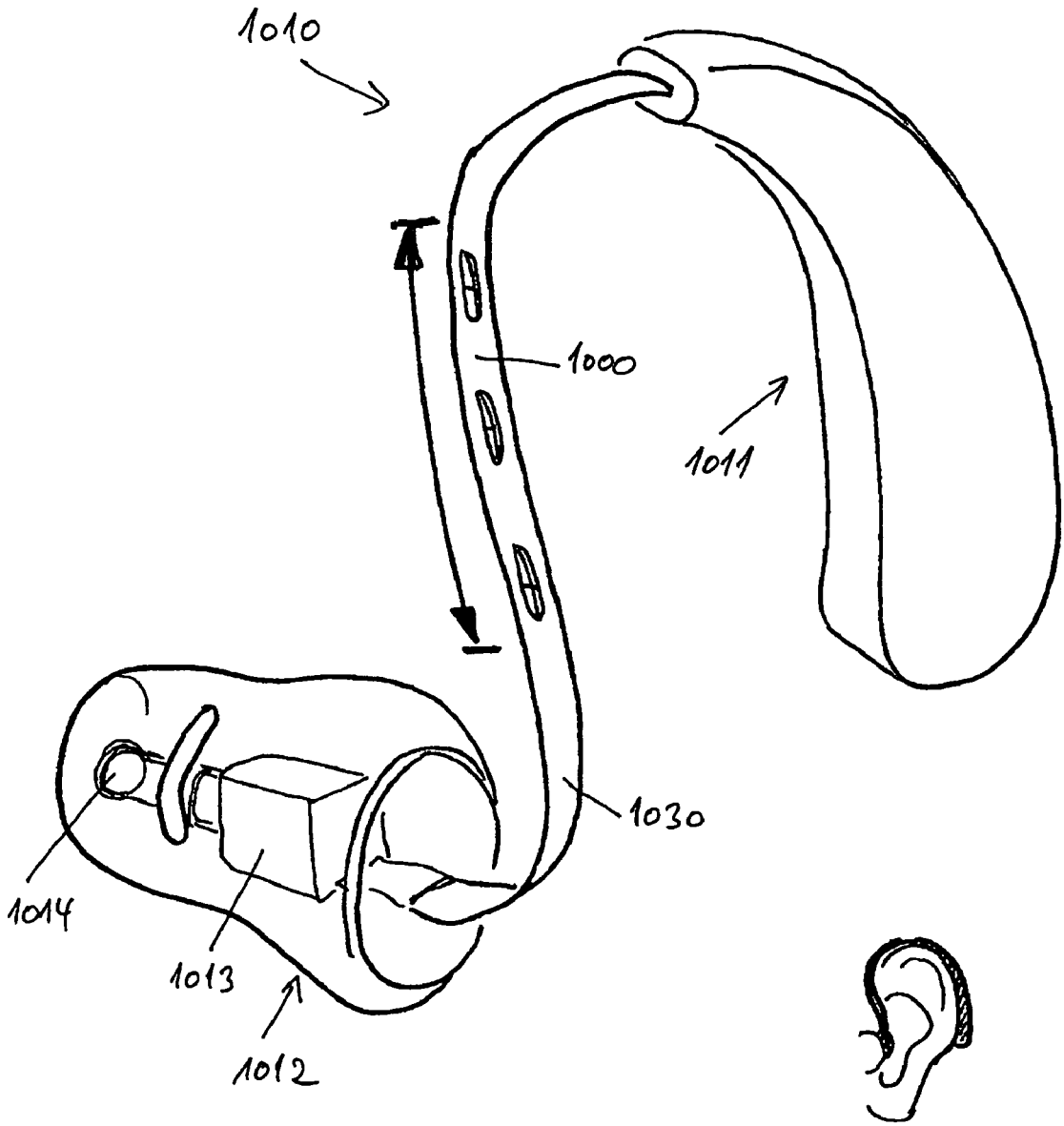
FIG. 11 shows a hearing aid with a BTE part and a CIC part comprising a receiver, the CIC and BTE parts being connected by a flexprint comprising three dome push knobs.

FIG. 11 shows a hearing aid 1010 with a BTE part 1011 and a CIC part 1012 interconnected by a flexible connector 1030 comprising a control panel 1000. The small sketch in the lower corner to the right shows the hearing aid 1010 mounted on a user's ear. The transparent view of the CIC part 1012 shows a receiver 1013 with a sound port opening 1014. The CIC part 1012 is adapted for position in a user's ear canal with the sound port opening 1014 close to the user's eardrum. Microphone and amplifier circuits may be positioned in the BTE part 1011 thus providing an acoustical and vibration separation of microphone and receiver 1013 thus providing a large feedback suppression. The flexible connector 1030 is used to electrically connect the amplifier circuit in the BTE part 1011 with the receiver 1013 in the CIC part 1012. In addition, a part of the flexible connector 1030 is used to implement a control panel 1000 according to the present invention. Three dome shaped activation zones are sketched on the control panel part 1000 of the flexible wire 1030. Two of these activation zones may be used for volume controls and one of the activation zones may be used for MTO selector.

A communication unit of the control panel 1000 may comprise one or two plugs positioned in the ends of the flexible connector 1030. Hereby it is possible to disconnect the flexible connector 1030 from one or both of the BTE part 1011 and the CIC part 1012 thus making the control panel 1000 interchangeable. With plugs positioned in both ends of the flexible connector 1030 it is possible to change the control panel independent on the BTE 1011 and CIC 1012 parts. It may also be preferred to have only one plug positioned in the CIC 1013 end of the flexible connector 1030. Hereby it is possible to disconnect the BTE part 1011 and the CIC part 1012, however still the flexible connector 1030 and thereby the control panel 1000 is still connected to the BTE part 1011. This may be preferred since the features provided by the control panel may be related to the electronics and number of microphones comprised within the BTE part 1011.

In the embodiment shown in FIG. 11 it is important that the layered structure of the control panel is formed by thin and flexible materials.

By all embodiments of control panels according to the present invention activation of the one or more activation zones can be electrically sensed by electronic detecting means connected to the control panel. The electronic detecting means must be adapted for performing an update in the function of the hearing aid according to the user's activation of the one or more activation zones. A number of parameters relating to operational functions is therefore determined by the electronic detecting means. Such parameters can be programmed into the hearing aid together with other individual audiological parameters controlling the function of the hearing aid. Hereby it is possible to adapt the operational function to individual preferences.

For example a volume control formed by two buttons—one for upward volume adjustment and one for downward volume adjustment. Still a number of parameters relating to the operation of such volume control is electronically adjustable: volume adjustment step size per single press of a button, a delay time before switching from a single step adjustment mode to a repetition adjustment mode in case a button is held down, or a "reset" function selecting a predetermined preferred volume level if both buttons are depressed simultaneously. Such adjustment of operational parameters by the electronic detecting means is known by the skilled person and is outside the scope of the present invention.

Various materials such as thermo plastics may be used for the substrate as well as for the surface layer. Preferred materials are polyimide, polyethylene, polypropylene, polycarbonate.

The invention claimed is:

1. An interchangeable hearing aid control panel comprising:

at least one activation zone capable of being in an actuated state and in a deactuated state, a layered structure comprising:

an electrically non-conducting substrate, a first electrically conducting path arranged in connection with the substrate, wherein the first electrically conducting path exhibits an electrical resistance of more than 1 Ω/m along its major axis of extension, and an electrically conducting member resiliently arranged at a predetermined distance from the first electrically conducting path, and a connector adapted to provide an associated hearing aid with information regarding activation of the at least one activation zone, wherein the first electrically conducting path and the electrically conducting member are electrically connected in the actuated state and disconnected in the deactuated state.

2. A control panel according to claim 1, wherein the layered structure forms an elongated structure.

3. A control panel according to claim 2, wherein the elongated structure has a length within the range 1-4 cm.

4. A control panel according to claim 1, wherein the connector provides externally accessible contact to at least one end of the conducting path.

5. A control panel according to claim 1, wherein the non-conducting substrate is made of a flexible plastic material.

6. A control panel according to claim 1, wherein the electrically conducting member comprises an electrically conducting foil.

7. A control panel according to claim 1, wherein the at least one activation zone is arranged along the first electrically conducting path.

8. A control panel according to claim 7, wherein an electrical potential difference is provided between a first and a second end of the first electrically conducting path so as to provide an electrical voltage between the first end of the first electrically conducting path and the electrically conducting member in the actuated state.

9. A control panel according to claim 1, further comprising a second electrically conducting path being arranged in connection with the layered structure so as to be electrically connected with the electrically conducting member in the actuated state.

10. A control panel according to claim 9, wherein the first and second electrically conducting paths are arranged substantially parallel to each other.

11. A control panel according to claim 1, wherein the control panel is adapted to provide an operator with a tactile feedback upon activation of the at least one activation zone.

12. A control panel according to claim 11, wherein the tactile feedback upon activation is provided by a resilient dome formed by a surface layer.

13. A control panel according to claim 1, further comprising a surface layer being an electrically non-conducting foil based on a material selected from the group consisting of: thermo plastics, polyimide, polyethylene, polypropylene, and polycarbonate.

14. A control panel according to claim 1, wherein the connector comprises a communication unit adapted for wireless communication of the information regarding activation of the at least one activation zone to the associated hearing aid.

15. A control panel according to claim 1, further comprising one or more integrated Silicon-based miniature microphones.

16. A control panel according to claim 15, wherein the layered structure further comprises a surface layer, and wherein a sound inlet port of the one or more integrated Silicon-based miniature microphones is positioned behind the surface layer so as to protect the one or more integrated Silicon-based miniature microphones.

17. A control panel according to claim 1, comprising at least two activation zones.

* * * * *

UNITED STATES PATENT AND TRADEMARK OFFICE

CERTIFICATE OF CORRECTION

PATENT NO. : 7,394,911 B2
APPLICATION NO. : 10/885073
DATED : July 1, 2008
INVENTOR(S) : Martin Bondo Joergensen and Joergen Ahm Petersen It is certified that error appears in the above-identified patent and that said Letters Patent is hereby corrected as shown below:

Title page, item [73] the Assignee's name should read --Sonion Roskilde A/S--.

Signed and Sealed this

Seventh Day of October, 2008

JON W. DUDAS
*Director of the United States Patent and Trademark Office*